US007930981B2

(12) United States Patent
Coffey et al.

(10) Patent No.: US 7,930,981 B2
(45) Date of Patent: Apr. 26, 2011

(54) ADJUSTABLE RIFFLER ASSEMBLY

(76) Inventors: Lonnie A. Coffey, Knoxville, TN (US); Robert L. Frank, Spring City, TN (US)

( * ) Notice: Subject to any disclaimer, the term of this patent is extended or adjusted under 35 U.S.C. 154(b) by 416 days.

(21) Appl. No.: 12/061,126

(22) Filed: Apr. 2, 2008

(65) Prior Publication Data

US 2009/0249987 A1 Oct. 8, 2009

(51) Int. Cl.
*F23K 3/02* (2006.01)

(52) U.S. Cl. ..... 110/263; 110/104 R; 209/506

(58) Field of Classification Search ..... 406/155, 406/156, 181, 182, 183, 192, 195; 193/31 R; 110/309, 310, 232, 106, 104 R; 241/119, 241/79; 209/506, 143, 44, 437, 438
See application file for complete search history.

(56) References Cited

U.S. PATENT DOCUMENTS

| | | | | |
|---|---|---|---|---|
| 1,354,747 | A | 10/1920 | Hiller | |
| 1,757,634 | A * | 5/1930 | Jacques | 406/183 |
| 2,975,001 | A | 3/1961 | Davis | |
| 6,789,488 | B2 | 9/2004 | Levy et al. | |
| 7,013,815 | B2 * | 3/2006 | Levy et al. | 110/106 |
| 7,017,501 | B2 * | 3/2006 | Mann | 110/106 |
| 2007/0095260 | A1 * | 5/2007 | John | 110/106 |

* cited by examiner

*Primary Examiner* — Kenneth B Rinehart
*Assistant Examiner* — David J Laux
(74) *Attorney, Agent, or Firm* — Pitts & Brittian, P.C.

(57) ABSTRACT

An adjustable riffler can be used in a piping system connecting a pulverizer and a furnace. The adjustable riffler includes a support member, at least two plates spaced apart along an axis, and at least one inclined flange. The two plates include a fixed plate attached to the support member and a translatable plate positioned adjacent to the fixed plate. The translatable plate is translatable along the axis with respect to the fixed plate. The at least one inclined flange is connected to one of the fixed plate and the translatable plate and extends along the axis between the plates to form a channel between the fixed plate and the translatable plate.

13 Claims, 3 Drawing Sheets

ADJUSTABLE RIFFLER ASSEMBLY

TECHNICAL FIELD

This application pertains in general to a device for dividing pulverized fuel evenly between two branches in a piping system running between a pulverizer and a furnace.

BACKGROUND

Pulverized fuel is mixed with air, and pneumatically transported from a pulverizer to a furnace through a series of pipes. Furnaces typically have multiple burners spaced-apart, so an initial pipe accepting pulverized fuel from the pulverizer must split into branches in order to introduce fuel to each burner. Conventional riffler assemblies, such as the Pulverized Coal Distributor disclosed in U.S. Pat. No. 1,757,634 to S. A. Jacques, include a plurality of fixed, evenly spaced-apart triangular plates with flanges on alternating sides of the plates in order to form two sets of discharge channels, a first set directing pulverized fuel to a first branch and a second set directing pulverized fuel to a second branch.

SUMMARY

In one example of the invention, an adjustable riffler is provided for use in a piping system connecting a pulverizer and a furnace. The adjustable riffler includes a support member and at least two plates spaced apart along an axis. The two plates include a fixed plate attached to the support member and a translatable plate positioned adjacent to the fixed plate. The translatable plate is translatable along the axis with respect to the fixed plate. At least one inclined flange is connected to one of the fixed plate and the translatable plate. The inclined flange extends along the axis between the plates to form a channel between the fixed plate and the translatable plate.

In another example, an adjustable riffler assembly is used in a conduit at the junction of a piping branch. The assembly includes an adjustable riffler and at least one conventional riffler positioned next to the adjustable riffler.

BRIEF DESCRIPTION OF THE DRAWINGS

The description herein makes reference to the accompanying drawings wherein like reference numerals refer to like parts throughout the several views.

DETAILED DESCRIPTION OF THE EMBODIMENTS

To achieve maximum efficiency, each burner in a furnace should receive a substantially equal amount of pulverized fuel. Conventional rifflers feature multiple channels, an equal number of which open to each branch in a piping system. However, "ropes" of concentrated fuel can form in the piping between the pulverizer and the burners. A rope of fuel may pass through a single channel in a conventional riffler. As a result, a high concentration of fuel can flow through the single channel, which can result in a few burners, or even a single burner, receiving a high concentration of pulverized fuel while the remaining burners receive little fuel. The present invention discloses an adjustable riffler enabling a desired amount of pulverized fuel, such as a substantially equal amount, to be directed into each branch of a piping system.

Figure 1:
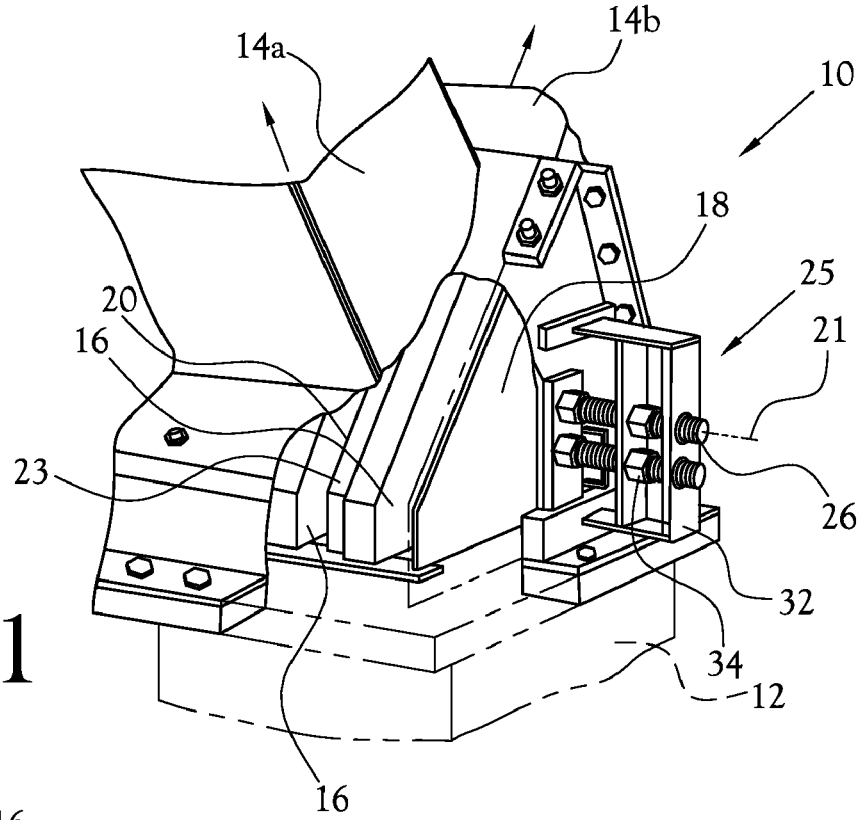
FIG. 1 is a partially cut-away perspective view of a piping system with two branches and a cutaway illustrating an adjustable riffler located in the piping system at the split in piping.
Figure 7:
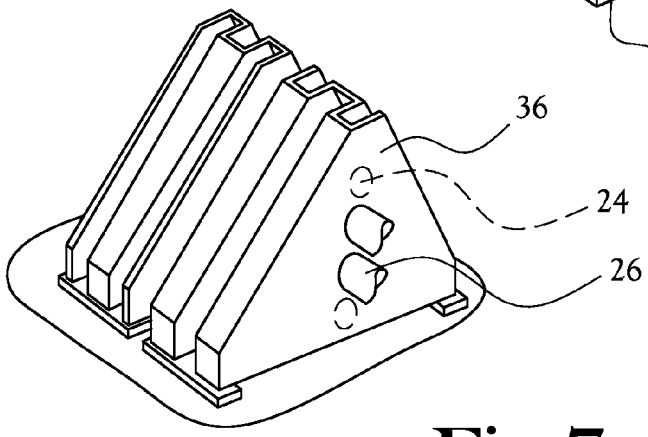
FIG. 7 is a perspective view of two conventional rifflers having more channels opening to one branch tan another branch.
Figure 8:
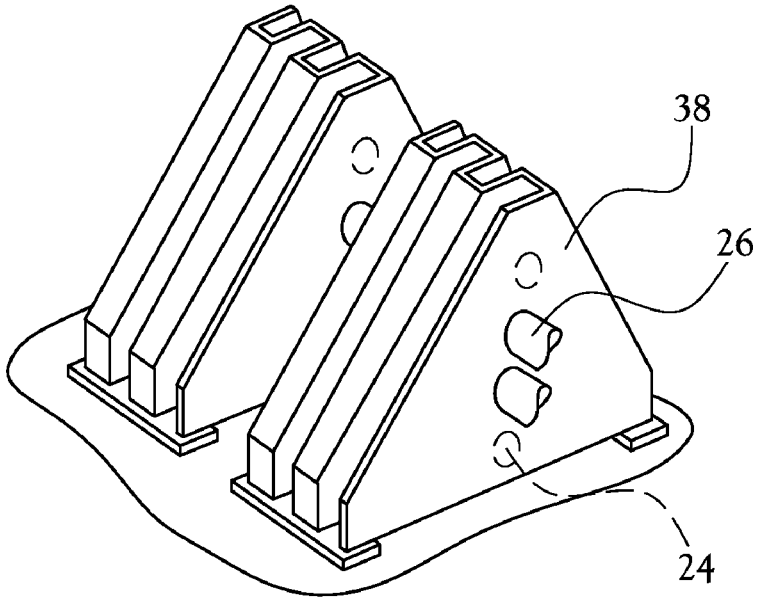
FIG. 8 is a perspective view of two conventional rifflers having an equal number of channels opening to each branch.

FIGS. 1-6 illustrate examples of an adjustable riffler 10 for use in a pulverized fuel piping system 12 in the vicinity of a branch 14 in the piping system 12, while FIGS. 7 and 8 illustrate conventional rifflers 36 and 38 that can be placed in the piping system 12 along with the adjustable riffler 10. FIG. 1 illustrates a perspective view of the adjustable riffler 10 having a plurality of spaced-apart plates, including a translatable plate 16, a fixed end plate 18, and a fixed intermediate plate 20. The plates 16, 18 and 20 are spaced apart along an axis 21 extending the width of the adjustable riffler 10. Inclined flanges 22 and 23 are fixed to the plates 16, 18 and 20 to define alternating channels between the plates 16, 18 and 20. Each translatable plate 16 can be translated along the axis 21 in order to alter the width of the channels. The arrows in FIG. 1 indicate a path in which pulverized fuel can flow through the adjustable riffler.

Figure 2:
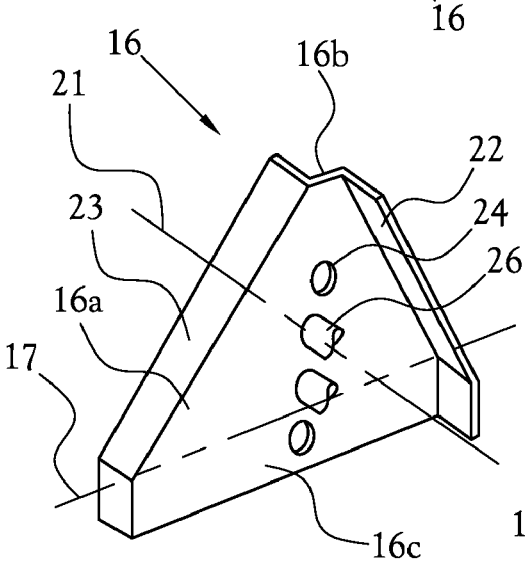
FIG. 2 is a perspective view of a translatable plate.

FIG. 2 illustrates an example of a translatable plate 16. The plate 16 includes a generally triangular portion 16*a* (i.e. the area above the axis 17 as illustrated) with a flat peak 16*b*, a rectangular portion 16*c* (i.e., the area below the axis 17 as illustrated), two inclined flanges 22 and 23, and apertures 24 (four shown). The plate 16 acts as the side wall of two channels, one on each side of the plate 16, for directing pulverized fuel. The shape of the triangular portion 16*a* permits the plate 16 to fit in a pulverized fuel piping system 12 at the split of the piping into two diverging branches 14. If the split in the piping system 12 immediately prior to the branches 14 is sufficiently large, the plate 16 can have a different shape, such as a square, rectangle, polygon, or other shape suitable for the application as known by those skilled in the art. The rectangular portion 16*c* of the plate 16 fits in the piping 12 upstream of the branches 14. Again, depending on the configuration of the piping system 12, the rectangular portion 16*c* may not be necessary, or it can take a different shape as permitted by the size of the piping 12. The translatable plates 16 can be made from steel. Alternatively, the translatable plates 16 can be made from other materials including ferrous and non-ferrous alloys, plastics, or composites suitable for withstanding the forces of fast-moving pulverized fuel known by those of skill in the art.

Also as illustrated in FIG. 2, a first inclined flange 22 projects from one side of the plate 16, and a second inclined flange 23 projects from the opposing side of the plate 16. The flanges 22 and 23 act as end walls of channels for directing pulverized fuel. The first and second flanges 22 and 23 can be inclined at opposite angles of equal magnitude, with the first flange 22 inclined to direct pulverized fuel into a first branch 14*a* in the piping system 12 and the second flange 23 inclined to direct pulverized fuel into a second branch 14*b* in the piping system 12. If the branches 14 are angled at different magnitudes, the flanges 22 and 23 can be angled at different magnitudes as well. While the illustrations show the flanges 22 and 23 as flat rectangular elements that bend in order to extend along peripheral edges of both the triangular portion 16*a* and the rectangular portion 16*c* of the plate 16, the flanges 22 and 23 can include curves or have other non-planar shapes so long as the shape of the flange 22 and 23 corresponds with the shape of the flanges 22 and 23, respectively, on other plates 18 and 20. Further, the flanges 22 and 23 can be formed without the bend that extends along the sides of the rectangular portion 16*c* of the plate 16 if desired. As illustrated, the flanges 22 and 23 project outward along the axis 21 from peripheral edges of the plate 16. However, the flanges 22 and 23 can alternatively project outward along the axis 21 from the surface of the plate 16. Alternatively, the first flange 22 can project from the surface of the plate 16 and the second flange 23 can project from the peripheral edge of the plate 16 or vice versa. The flanges 22 and 23 can be lengths of steel welded to the plate 16. Alternatively, the flanges 22 and 23 can be made from other ferrous or non-ferrous alloys, plastics, or composites suitable for withstanding the forces of fast-moving pulverized fuel known by those of skill in the art. The flanges 22 and 23 can be formed integrally with the plate 16, either already projecting from the plate 16 along the axis 21 or formed into place. Also as illustrated, the flanges 22 and 23 project from the plate 16 at a ninety degree angle. However, the flanges 22 and 23 can project at a different angle so long as the flanges 22 and 23 are generally parallel to each other and the flanges 22 and 23 on any adjacent plates. Each flange 22 or 23 can have the same or varying widths.

Figure 5:
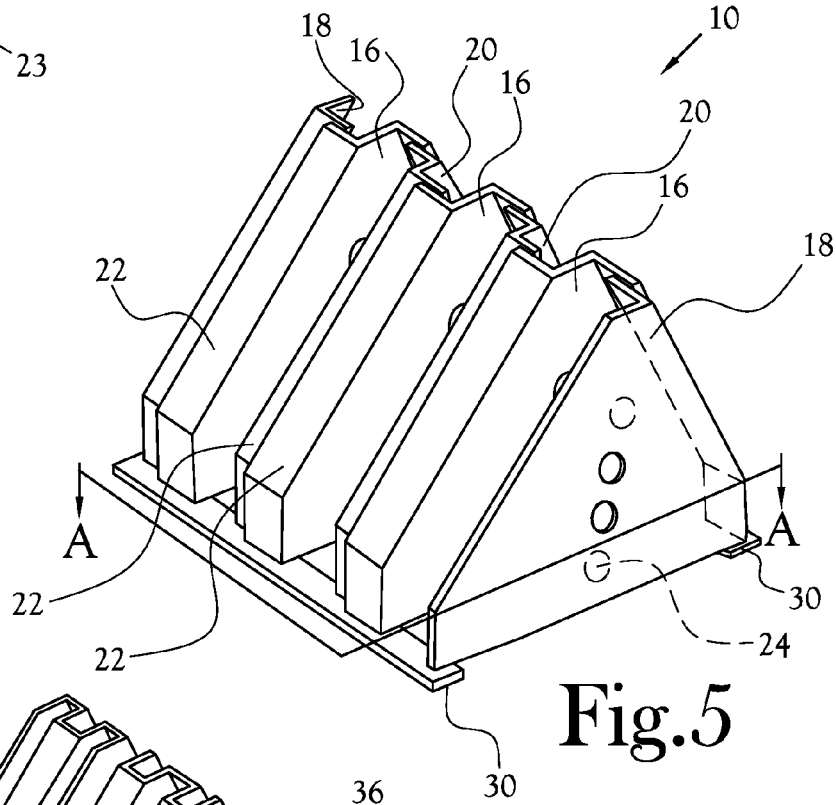
FIG. 5 is a perspective view of an example of an adjustable riffler.
Figure 6:
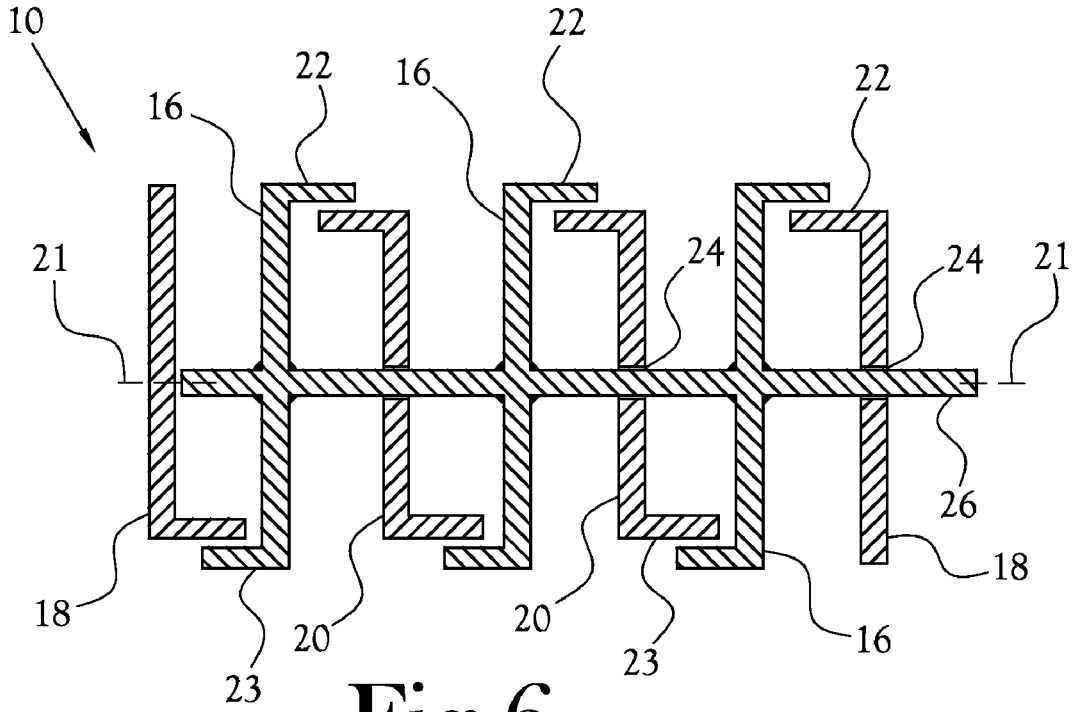
FIG. 6 is a cross sectional view of the adjustable riffler of FIG. 5 from above a plane A-A defined in FIG. 5.

As shown in FIGS. 2, 5 and 6, the apertures 24 can be included on the plate 16 to accept translatable rods 26 and support structure rods 28. Four apertures 24 are included on the plate 16 as illustrated in FIG. 2. The middle two apertures 24 accept the translatable rods 26, which are attached to the perimeters of the apertures 24, while the remaining two apertures 24 accept support structure rods 28. The distribution of apertures 24 on the surface of the plates 16 need not be as illustrated, and a greater or lesser number of apertures 24 can be included. For example, as structures other than rods 26 and 28 can be used for translating the translatable plates 16 and supporting the fixed plates 18 and 20, respectively, as discussed below, apertures 24 are not always required. However, apertures 24 facilitate assembly and reduce the number of components when the translatable rods 26 or support structure rods 28 are used.

Figure 3:
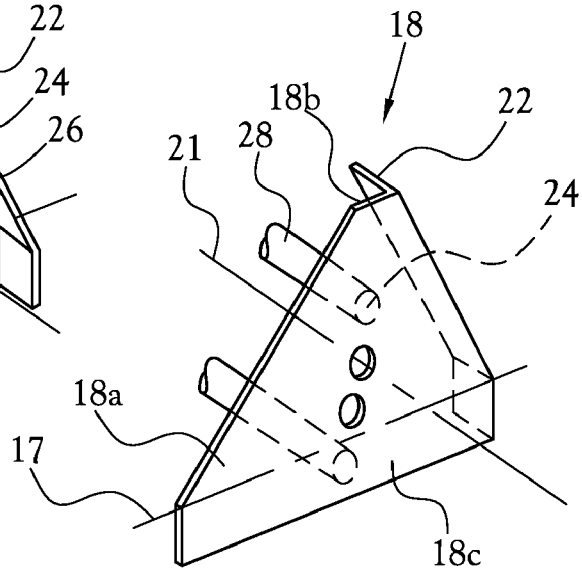
FIG. 3 is a perspective view of a fixed end plate.

FIG. 3 illustrates an example of a fixed end plate 18. Fixed end plates 18 are similar to translatable plates 16, and include a generally triangular portion 18*a* (i.e., the portion of the plate 18 above the axis 17), a generally rectangular portion 18*b* (i.e., the portion of the plate 18 below the axis 17) and apertures 24. However, each fixed end plate 18 includes only one inclined flange 22 or 23 because the end plate 18 is a side wall for just one channel for directing pulverized fuel. The side of the fixed end plate 18 opposite the channel abuts the piping system 12 or conventional riffler 36 or 38 when the adjustable riffler 10 is installed. The flange 22 or 23 on each end plate 18 overlaps one of the flanges 22 or 23 on an adjacent translatable plate 16 in order to create an end wall for the channel between the translatable plate 16 and the end plate 18. Thus, even if the translatable plate 16 is translated along the axis 21, the end wall remains intact. This configuration requires the flange 22 or 23 on the end plate 18 to be slightly offset from the adjacent flange 22 or 23 on the translatable plate 16 in a direction perpendicular to the axis 21 as best seen in FIG. 6. For example, if a flange 22 or 23 is welded to the peripheral edge of the translatable plate 16, the edge of the flange 22 or 23 on the fixed end plate 18 can be offset from a peripheral edge of plate 18 and welded to the surface of the fixed end plate 18 such that the flange 22 or 23 on the translatable plate can overlap the flange 22 or 23 on the fixed end plate. Apertures 24 for support structure rods 28 are optional on end plates 18, as support structures rods 28 can be welded or otherwise connected to the surface of end plates 18 even if there are no apertures 24. Likewise, if a translatable rod 26 is attached to the perimeters of apertures 24 on translatable plates 16, apertures 24 for the translatable rod 26 need only be included on one end plate 18, as the rod 26 need not extend through both end plates 18. Otherwise, the same size, shape, and construction features of the translatable plates 16 can apply to the fixed end plates 18.

Figure 4:
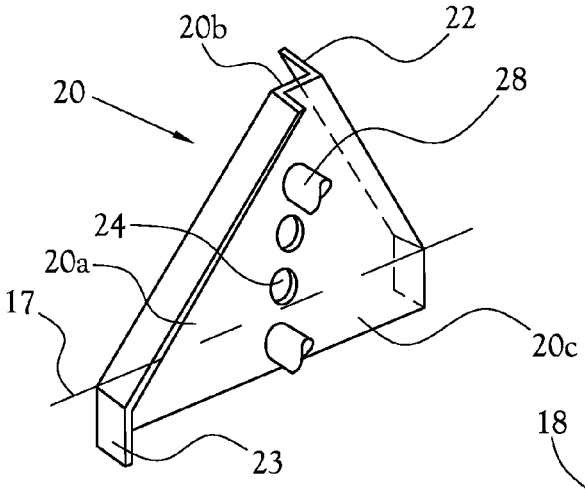
FIG. 4 is a perspective view of a fixed intermediate plate.

FIG. 4 illustrates a fixed intermediate plate 20. Fixed intermediate plates 20 can be identical to translatable plates 16 in structure, and differ only in how they are attached to the adjustable riffler 10. However, though they are bound by some of the same size, shape, and connectivity restrictions as translatable plates 16, fixed intermediate plates 20 need not be identical to translatable plates 16. For example, if the size of the piping system 12 permits square shaped plates, fixed intermediate plates 20 can be triangular even if translatable plates 16 are square. The flanges 22 and 23 on the fixed intermediate plates 20 can overlap the flanges 22 and 23 on adjacent translatable plates 16 in order to create an end wall for each channel. Overlapping the flanges 22 and 23 on the translatable plates 16 and the intermediate plates 20 generally requires that the plates be slightly offset in a direction perpendicular to the axis 21 and that the flanges 22 and 23 on the translatable plates 16 and intermediate plates 20 parallel. Overlapping can be achieved by fixing the flanges 22 and 23 to peripheral edges of the translatable plate 16, and fixing flanges 22 and 23 to surfaces of the intermediate plate 20, or vice versa. Alternatively, the flange 22 on each of the translatable plate 16 and intermediate plate 20 can be fixed to a peripheral edge of each plate 16 and 20, and the flange 23 can be fixed to a surface adjacent the peripheral edge. The latter configuration allows the translatable plate 16 and intermediate plate 20 to be identical. Thus, even if the translatable plates 16 are translated, the end wall remains intact. The remaining size, shape, and construction features of the translatable plates 16 apply to the fixed end plates 20.

As illustrated in FIG. 5, an example of a support structure of the adjustable riffler 10 includes beams 30 fixed to the fixed plates 18 and 20. The beams 30 are illustrated attached to the fixed plates 18 and 20 at the two base corners of the fixed plates 18 and 20. An additional beam 30 (not shown) can be included fixed to the flat peaks 18*b* and 20*b* of each fixed plate 18 and 20. The support structure can additionally include support structure rods 28 as illustrated in FIGS. 3 and 4. The rods 28 can be inserted through the apertures 24 in the plates 16, 18 and 20, and are connected to the fixed plates 18 and 20. Depending on the application, fewer or more support structures rods 28 and/or beams 30 can be used. For example, additional beams 30 can be attached on the edges of the rectangular portions 18*c* and 20*c* of the plates 18 and 20. As another example, if the beams 30 alone provide sufficient support, the rods 28 attached to the fixed plates 18 and 20 need not be included. In this case, apertures 24 in the plates 16, 18 and 20 for the rods 28 are also not necessary. On the other hand, if rods 28 provide sufficient support, beams 30 need not be included. Other structures and methods of supporting the adjustable riffler 10 known by those skill in the art may alternatively or additionally be used.

In the example shown in FIG. 1, the structure provided for translation is a jack 25 including two threaded rods 26, a guide 32, and nuts 34. The rods 26 extend from external the piping system 12 and, as shown in FIG. 6, through the apertures 24 in each plate 16, 18 and 20, though they need not extend through the end plate 18 on the opposite side of the adjustable riffler 10 from the threaded portion of the rods 26. The rods 26 are connected to the translatable plates 16 in order to translate the plates 16. The use of multiple rods 26 provides stability to the plates 16, though multiple rods 26 are not necessary. The rods 26 are not connected to the fixed plates 18 and 20 in order to permit the rods 26 to move the translatable plates 16 relative to the fixed plates 18 and 20 along the axis 21. The nuts 34 can abut the guide 32 in order to prevent the nuts 34 from moving parallel to the installation axis 34 when rotated, thereby ensuring the rods 26 translate. The guide 32 can also brace the rods 26. Alternative methods of translation for the plates 16 can be used. For example, instead of rods 26, one or more beams (not shown) can be attached to peripheral edges of the translatable plates 16. The beams can extend outside the piping system 12, and a ratchet system can translate the beams. As alternative examples, pneumatic cylinders or a strong cable, (e.g., a chain) can be attached to the translatable plates 16 in order to allow translation. Also, the translatable plates 16 need not be moved in synchronization. Each translatable plate 16 can be independently attached to the structure provided for translation so that the channels are individually adjustable. If the plates 16 are independently adjustable, fixed intermediate plates 20 are not necessary, but can still be included if desired.

From a centered position in which the channels on each side of a translatable plate 16 are equally wide along the axis 21, the distance that the translatable plate 16 can be moved can be limited to a distance up to half the width of its flanges 22 and 23 along the installation axis 21. This translation limit ensures that the end wall, which is formed by overlapping flanges 22 or 23, of a channel does not have gaps permitting fuel to travel into an unintended branch 14. The illustration shown in FIG. 6 is useful for understanding the benefit of overlapping flanges 22 and 23. If each translatable plate 16 is moved to the left along the axis 21 in FIG. 6 until the plate 16 abuts the flange 23 on the fixed plate 18, 20 to its left, the flange 22 projecting from the right side of the translatable plate 16 still overlaps the flange 22 on the fixed plate 18, 20 to its right.

To assemble the adjustable riffler 10, the support structures, for example support structure rods 28 and beams 30, can be welded to one end plate 18. A translatable plate 16 can be placed adjacent to the end plate 18 along the axis 21 by inserting the rods 28 through apertures 24 in the translatable plate 16. Translatable rods 26 can be inserted through apertures 24 in the plates 16 and 18 and welded to the translatable plate 16. An intermediate fixed plate 20 can be placed adjacent to the translatable plate 16 by inserting both rods 26 and 28 through apertures 24 in the fixed plate 20, then welding the support structure rods 28 and/or beams 30 to the fixed plate 20. A second translatable plate 16 is placed adjacent to the intermediate fixed plate 20 as described above, and the translatable plate 16 is welded to the translatable rods 26. This process continues until all the plates 16, 18 and 20 are in place. The process can also be varied depending on the arrangement of plates 16, 18 and 20, e.g., intermediate fixed plates 20 can be omitted if each translatable plate 16 is independently adjustable.

Once the adjustable riffler 10 is assembled, it can be placed into the piping system 12 of a burner. The adjustable riffler 10 is arranged so that the channels open into the different branches 14 in the piping system 12 as illustrated in FIG. 1. The piping system 12 can be sealed once the riffler 10 is placed inside, though the piping system 12 includes openings for the translatable rods 26. The jack 25 is attached to the piping system 12 and can include at least one nut 34 for each translatable rod 26. The nuts 34 are rotated to translate the translatable rod 26, and thus the translatable plates 16, in one direction or another. The rotation of the nuts 34 can be based on an analysis of the efficiency of the burner system. The efficiency determination can be based on the distribution of pulverized fuel to each burner. To determine the distribution of pulverized fuel, the piping system 12 can be physically inspected to look for signs of "roping", the piping 12 can be sampled at various stages, or the amount of fuel delivered to each burner can be determined. If the analysis shows that an unequal amount of pulverized fuel is being directed to one branch 14*a* or another 14*b*, the nuts 34 can be rotated to increase the width of the channels directing fuel to a branch 4*a*, for example, receiving too little fuel and decrease the width of the channels directing fuel to a branch 14*b* receiving too much fuel.

Multiple adjustable rifflers 10 can be placed into a single piping system 12, or the adjustable riffler 10 can be placed into the piping 12 along with one or more conventional, non-adjustable rifflers 36 and 38. As illustrated by FIGS. 7 and 8, respectively, the non-adjustable rifflers 36 and 38 can have more channels opening to one branch 14*a*, for example, than another branch 14*b* or have an equal number of channels opening to each branch 14. Multiple non-adjustable rifflers 36 and 38 can be placed into the piping system 12 with the adjustable riffler 10. The non-adjustable rifflers 36 and 38 can include apertures 24 to accommodate the extension of translatable rods 26 to outside the piping system 12. The adjustable riffler 10 can be located in the piping system 12 where ropes are most apt to form in order to provide adjustability, while non-adjustable rifflers 36 and 38 can be placed where ropes are unlikely to form. Additionally, if testing shows an unequal distribution of pulverized fuel, non-adjustable rifflers 36 having more channels opening to one branch 14*a*, for example, than another branch 14*b* can be included in addition to the adjustable riffler 10 to even out the distribution.

The above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. An adjustable riffler for use in a piping system connecting a pulverizer and a furnace, the adjustable riffler comprising: a support member; at least two plates spaced apart along an axis, the at least two plates including a fixed plate attached to the support member and a translatable plate positioned adjacent to the fixed plate and translatable along the axis with respect to the fixed plate; and at least one inclined flange connected to one of the fixed plate and the translatable plate and extending along the axis between the plates to form a channel between the fixed plate and the translatable plate, wherein the at least one inclined flange includes a first inclined flange oriented to direct fuel into a first piping branch and a second inclined flange oriented to direct fuel into a second piping branch, and wherein the translatable plate includes a first inclined flange and a second inclined flange, and the fixed plate comprises a first fixed plate having a first inclined flange and a second fixed plate having a second inclined flange, and wherein the first inclined flange on the translatable plate overlaps the first inclined flange on the first fixed plate, and the second inclined flange on the translatable plate overlaps the second inclined flange on the second fixed plate.

2. The adjustable riffler of claim 1, wherein the translatable plate is disposed between two fixed plates along the axis.

3. The adjustable riffler of claim 1, further comprising at least one intermediate plate connected to the support member and including a first inclined flange and a second inclined flange.

4. The adjustable riffler of claim 1, wherein the inclined flange is positioned at an angle of about ninety degrees relative to the plates.

5. The adjustable riffler of claim 1, further comprising a jack including a guide positioned external the piping system and defining an aperture, a threaded rod connected to the translatable plate and positioned to extend through the aperture, and a nut threaded onto the threaded rod.

6. The adjustable riffler of claim 1, wherein the at least two plates comprise a generally triangular portion and a generally rectangular portion, and the inclined flange has a bend such that the shape of the at least one inclined flange corresponds to the shape of an edge of the plate extending from a vertex of the triangular portion to a corner of the rectangular portion.

7. The adjustable riffler of claim 1, wherein the at least one inclined flange is fixed to a peripheral edge of the one of the at least two plates.

8. The adjustable riffler of claim 1, wherein each of the at least one inclined flange has substantially the same width along the axis.

9. The adjustable riffler of claim 1, wherein the translatable plate partially defines a first channel and a second channel, the first and second channels on opposing sides of the translatable plate along the axis, and the translatable plate has a centered position in which the first channel is equal in size to the second channel, and wherein the translatable plate is translatable along the axis by a distance up to half a width of the first channel.

10. The adjustable riffler of claim 1, further comprising at least one translatable rod, wherein each plate defines an aperture aligned along the axis and the translatable rod is positioned through the aperture in each plate, connected to the translatable plate and translatable relative to the fixed plate.

11. The adjustable riffler of claim 1, wherein the translatable plate is translatable along the axis.

12. The adjustable riffler of claim 1, wherein the support member includes at least one of a rod connected to each fixed plate and a beam connected to a peripheral edge of each fixed plate.

13. An adjustable riffler assembly for use in a piping system comprising: a support member; a plurality of fixed plates attached to the support member, the fixed plates spaced apart along an axis and oriented substantially in parallel, the fixed plates including a first end plate having a first triangular portion and defining at least one aperture, a first flange fixed at substantially a right angle to the first end plate near an edge at least partially defining the first triangular portion, a second end plate having a second triangular portion, a second flange fixed at substantially a right angle to the second end plate near an at least partially defining the second triangular portion, at least one intermediate plate having a third triangular portion and defining at least one aperture, a third flange fixed at substantially a right angle to the at least one intermediate plate near a first edge at least partially defining the third triangular portion, and a fourth flange fixed to the at least one intermediate plate and oriented to extend from near a second edge at least partially defining the third triangular portion in a direction opposite the third flange, the at least one intermediate plate disposed between the first end plate and the second end plate; at least one translatable plate defining at least one aperture and having a fourth triangular portion, a fifth flange fixed at substantially a right angle to the at least one translatable plate near a first edge at least partially defining the fourth triangular portion, and a sixth flange fixed to the at least one translatable plate and oriented to extend from near a second edge at least partially defining the fourth triangular portion in a direction opposite the fifth flange, the at least one translatable plate oriented parallel to the plurality of fixed plates and disposed between a first and a second of the plurality of fixed plates fixed plate such that the fifth flange overlaps at least a portion of a flange on the first fixed plate to define a first channel between the translatable plate and the first fixed plate, and such that the sixth flange overlaps at least a portion of a flange on the second fixed plate to define a second channel between the translatable plate and the second fixed plate on an opposite side of the translatable plate than the first channel; and at least one translatable rod inserted through the apertures in the fixed plates and the at least one aperture in the at least one translatable plate, the rod fixed to the at least one translatable plate in order to translate the at least one translatable plate in a direction parallel to the axis.

* * * * *